US005397085A

United States Patent [19]

Spagnolo

[11] Patent Number: 5,397,085

[45] Date of Patent: Mar. 14, 1995

[54] SANDBAG FILLING AID

[76] Inventor: Andrew J. Spagnolo, P.O. Box 4, Llano, Calif. 93544

[21] Appl. No.: 178,010

[22] Filed: Jan. 6, 1994

[51] Int. Cl.[6] ..... A63B 55/04

[52] U.S. Cl. ..... 248/97; 248/101

[58] Field of Search ..... 248/95, 97, 99, 100, 248/101, 156, 129; 53/390; 141/391; 220/404

[56] References Cited

U.S. PATENT DOCUMENTS

| | | | |
|---|---|---|---|
| 2,462,973 | 3/1949 | Kelrick | 248/101 |
| 3,388,882 | 6/1968 | Burroughs | 248/101 X |
| 4,723,742 | 2/1988 | Krauss | 248/97 |
| 4,976,406 | 12/1990 | Buckley | 248/98 X |
| 5,058,839 | 10/1991 | Stevens | 248/101 |
| 5,080,308 | 1/1992 | Franks | 248/99 |
| 5,139,219 | 8/1992 | Navarro | 248/156 |
| 5,169,101 | 12/1992 | Wenzel | 248/99 X |
| 5,183,226 | 2/1993 | Brooks | 248/97 |
| 5,213,291 | 5/1993 | Wiebe | 248/97 |
| 5,228,654 | 7/1993 | Carpentier | 248/100 |

FOREIGN PATENT DOCUMENTS

| | | | |
|---|---|---|---|
| 708336 | 7/1931 | France | 248/97 |
| 15791 | of 1901 | United Kingdom | 248/97 |

*Primary Examiner*—J. Franklin Foss

[57] ABSTRACT

A new and improved sandbag filling aid for supporting a sandbag in an upright position and providing a fill-chute to enable a single person to rapidly and efficiently fill sandbags during emergency situations, the sandbag filling aid comprising an upright tubular frame structure having left and right parallel support columns, a first horizontal hoop member, a second horizontal hoop member, whereby a sandbag within the first hoop may be clamped in place by pivoting the second hoop downwardly until it contacts the sandbag, and an arcuate fill-chute member extending upwardly and slightly outwardly from the second hoop member such that when the second hoop member is positioned for clamping a sandbag the chute will catch and direct hastily shovelled or thrown sand into the mouth of the sandbag.

5 Claims, 4 Drawing Sheets

FIG 5
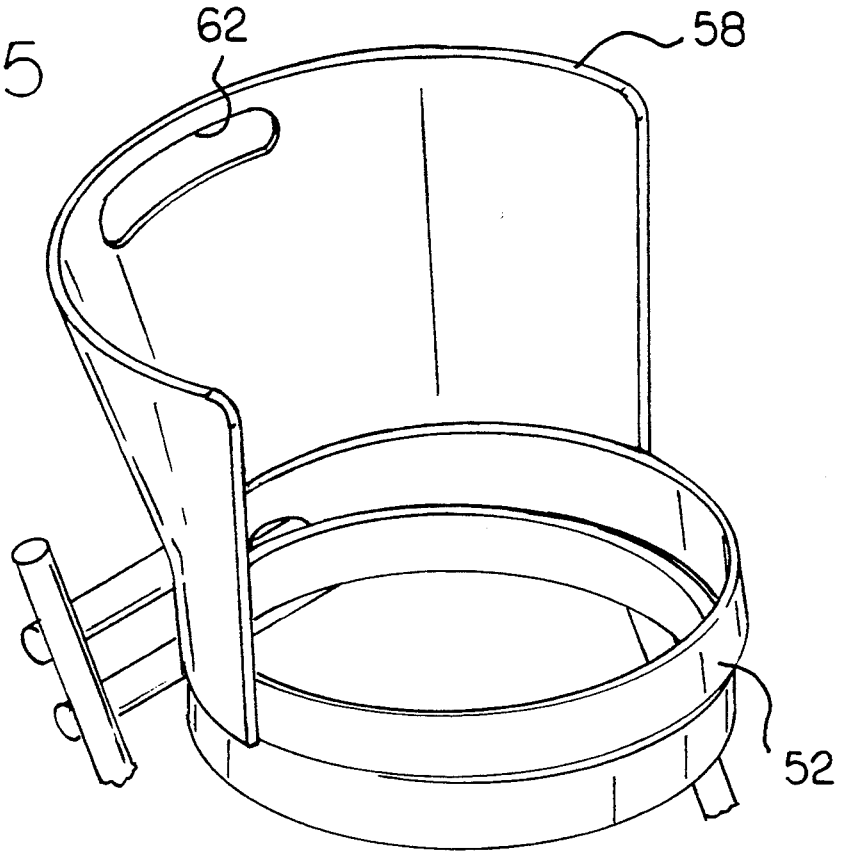
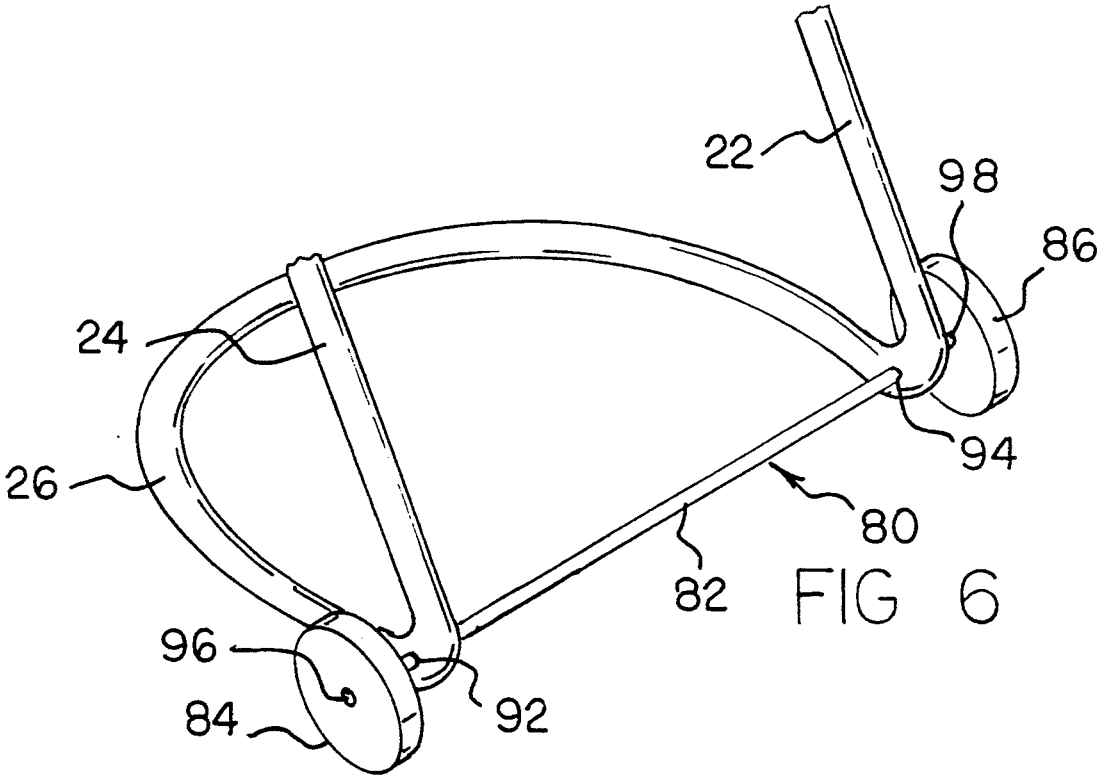
FIG 6

SANDBAG FILLING AID

BACKGROUND OF THE INVENTION

1. Field of the Invention

The present invention relates to bag support devices and more particularly pertains to sandbag filling aids which may be used for supporting a sandbag in an upright position and providing a fill-chute to enable a single person to rapidly and efficiently fill sandbags during emergency situations.

2. Description of the Prior Art

The use of sandbag filling aids is known in the prior art. More specifically, sandbag filling aids heretofore devised and utilized for the purpose of filling sandbags during emergency situations are known to consist basically of familiar, expected and obvious structural configurations, notwithstanding the myriad of designs encompassed by the crowded prior art which have been developed for the fulfillment of countless objectives and requirements.

The present invention is directed to improving devices for supporting a sandbag in an upright position and providing a fill-chute to enable a single person to rapidly and efficiently fill sandbags during emergency situations in a manner which is safe, secure, economical and aesthetically pleasing.

For example, U.S. Pat. No. 4,976,406 to Buckley et al. discloses a portable, self-supporting, collapsible utility stand for supporting a trash bag or the like in an upright manner with its top open to receive the deposit of trash or other material therein.

U.S. Pat. No. 5,080,308 to Franks discloses a bag support for maintaining the mouth of a bag in an open position that includes a base which is sized to be received within the bag and a pair of spaced apart support arms secured to the base; each of the support arms include two rigid portions connected by a resilient member.

Additionally, U.S. Pat. No. 4,723,742 to Krauss discloses a sandbag support incorporating a pair of U-shaped edge upstanding panel members. All three of the above inventions consist of frail structural elements which would not withstand service at an emergency sandbagging operation.

The prior art also discloses a trash bag holder as shown in U.S. Pat. No. 5,058,839 to Stevens which consists of a pair of circular support members interconnected by a pair of legs. The legs pivot at their respective midpoints such that the trash bag can be collapsed into a folded position for easy storage or carrying.

U.S. Pat. No. 5,183,226 to Brooks describes a universal collapsible bag support stand having upper and lower bag retainer rings interconnected at spaced apart locations by a pair of straight tubular column members.

Neither of the above disclosures provides a way to catch and direct material into the mouth of the bag.

In this respect, the sandbag filling aid according to the present invention substantially departs from the conventional concepts and designs of the prior art, and in so doing provides an apparatus primarily developed for the purpose of supporting a sandbag in an upright position and providing a fill-chute to enable a single person to rapidly and efficiently fill sandbags during emergency situations.

Therefore, it can be appreciated that there exists a continuing need for new and improved sandbag filling aids which can be used for filling sandbags during emergency situations. In this regard, the present invention substantially fulfills this need.

As illustrated by the background art, efforts are continuously being made in an attempt to develop devices for filling sandbags during emergency situations. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of sandbag filling aids now present in the prior art, the present invention provides an improved sandbag filling aid construction wherein the same can be utilized for supporting a sandbag in an upright position and providing a fill-chute to enable a single person to rapidly and efficiently fill sandbags during emergency situations. As such, the general purpose of the present invention, which will be described subsequently in greater detail, is to provide a new and improved sandbag filling aid apparatus and method which has all the advantages of the prior art sandbag filling aid and none of the disadvantages.

The invention is defined by the appended claims with the specific embodiment shown in the attached drawings. For the purpose of summarizing the invention, the invention may be incorporated into a new and improved sandbag filling aid for supporting a sandbag in an upright position and providing a fill-chute to enable a single person to rapidly and efficiently fill sandbags during emergency situations. The sandbag filling aid comprises an open frame having integral parallel left and right support columns. The frame is formed of rigid structural material such as tubular steel. The columns are supported in a generally upright position and connected together at their lower ends by a laterally extending integral horizontal arcuate base member. The columns are also fixedly connected together at their upper ends by an identical pair of vertically spaced apart horizontal cross-bar members. The columns are angled slightly away from vertical in the direction of the base member such that the frame center of gravity on a horizontal plane coincides with its geometric center thereby providing a stable tip-resistant structure. The sandbag filling aid also includes a first horizontal hoop formed of rigid structural material such as steel band. The first horizontal hoop has a diameter slightly smaller than the diameter of the mouth of a sandbag wherein the sandbag may be inserted and slightly overlapped whereby holding the sandbag in an upright open position. The first horizontal hoop is fixedly tangentially connected to the center of the lower cross-bar member such that it is centered between the left and right support columns and is also generally centered over the arcuate base member. The sandbag filling aid further includes a second horizontal hoop formed of the same material as the first horizontal hoop. The second-horizontal hoop has a diameter slightly larger than the diameter of the mouth of a sandbag. The second horizontal hoop is hingedly tangentially connected to the center of the upper cross-bar member such that it is centered over the first horizontal hoop whereby a sandbag inside the first hoop may be removedly clamped when the second hoop is rotated downwardly on its hinge to contact the overlapped sandbag on the first hoop. The second horizontal hoop also has an semicylindrical outwardly flaring chute member fixedly coaxially connected thereto. The chute member extends upwardly from the circumference of the second horizontal hoop whereby hastily shovelled or thrown sand is caught and directed into the open mouth of the sandbag clamped into the sandbag filling aid.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved sandbag filling aid for supporting a sandbag in an upright position and providing a fill-chute to enable a single person to rapidly and efficiently fill sandbags during emergency situations, the sandbag filling aid comprising an upright tubular frame structure having left and right parallel support columns; a first horizontal hoop member fixedly tangentially connected to the center of the lower cross-bar member wherein a sandbag may be inserted; a second horizontal hoop member hingedly tangentially connected to the center of the upper cross-bar member coaxially with the first hoop member whereby a sandbag within the first hoop may be clamped in place by rotating the second hoop downwardly until it contacts the sandbag; and an arcuate fill-chute member extending upwardly and slightly outwardly from the second hoop member such that when the second hoop member is positioned for clamping a sandbag the chute will catch and direct hastily shovelled or thrown sand into the mouth of the sandbag.

It is another object of the present invention to provide a new and improved sandbag filling aid which may be easily and efficiently manufactured and marketed.

It is a further object of the present invention to provide a new and improved sandbag filling aid which is of a durable and reliable construction.

An even further object of the present invention is to provide a new and improved sandbag filling aid which is susceptible of a low cost of manufacture with regard to both materials and labor, and which accordingly is then susceptible of low prices of sale to the consuming public, thereby making such sandbag filling aid s economically available to the buying public.

Still yet another object of the present invention is to provide a new and improved sandbag filling aid which provides in the apparatuses and methods of the prior art some of the advantages thereof, while simultaneously overcoming some of the disadvantages normally associated therewith.

Still yet another object of the present invention is to provide a new and improved sandbag filling aid which is so simple to use anyone will be able to participate in emergency sandbag filling operations without training.

Yet another object of the present invention is to provide a new and improved sandbag filling aid which is useful during darkness in remote unlighted locations.

Even still another object of the present invention is to provide a new and improved sandbag filling aid which is relatively light weight for easy transportation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective view of a first modification of the invention of FIG. 1 wherein a hand-grip opening has been added to the fill-chute.

FIG. 6 is a perspective view of a second modification of the invention of FIG. 1 wherein transport wheels have been added to the base member.

DESCRIPTION OF THE PREFERRED EMBODIMENT

Figure 1:
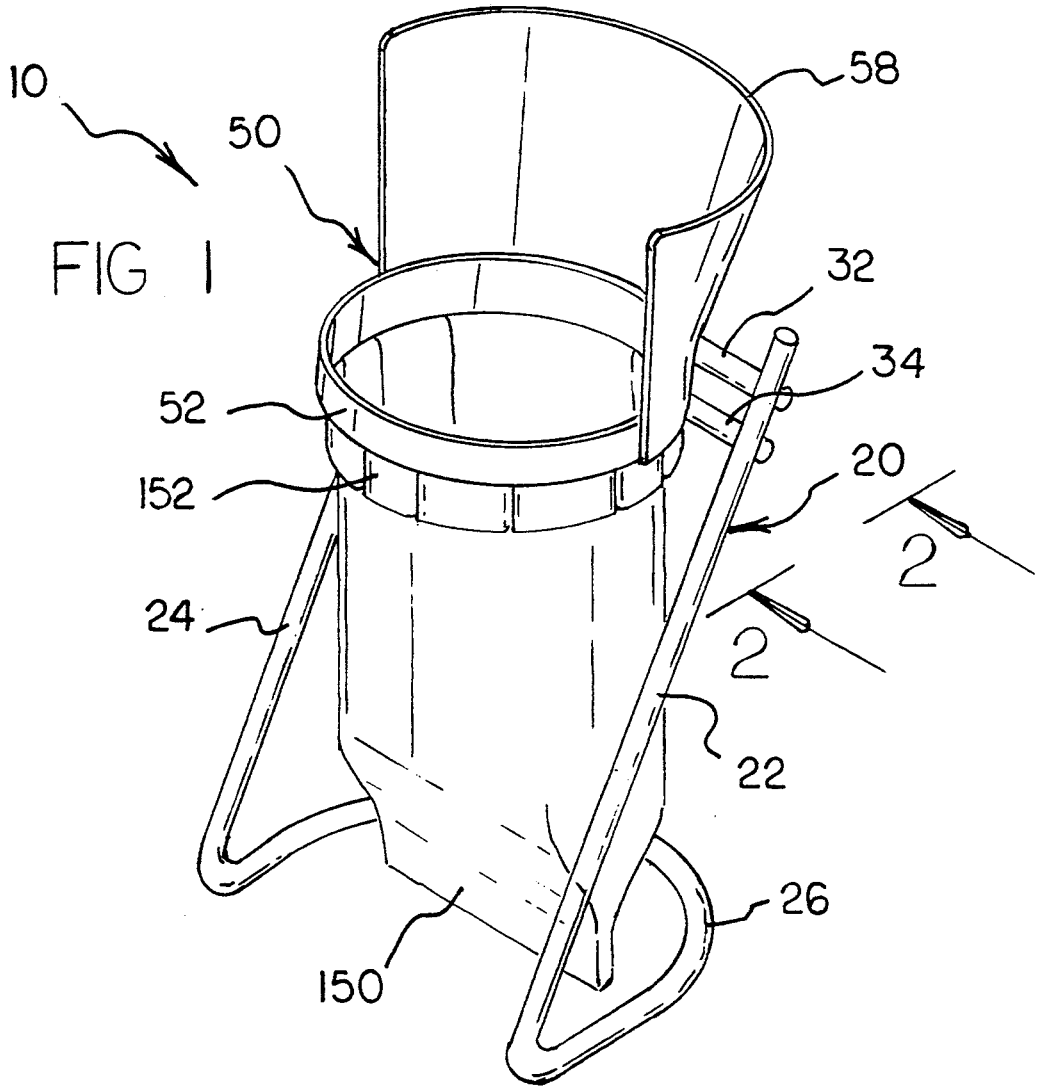
FIG. 1 is a perspective view of the invention shown with a sandbag clamped into position for filling.
Figure 2:
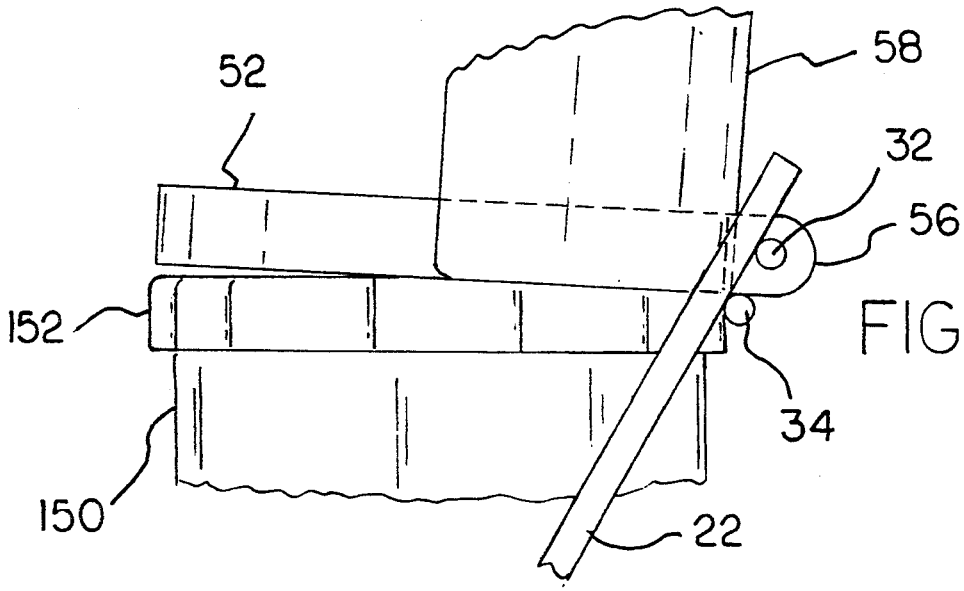
FIG. 2 is a detail view of the side of the invention of FIG. 1, taken along the line 2—2, illustrating the manner in which the sandbag is clamped into the device.
Figure 3:
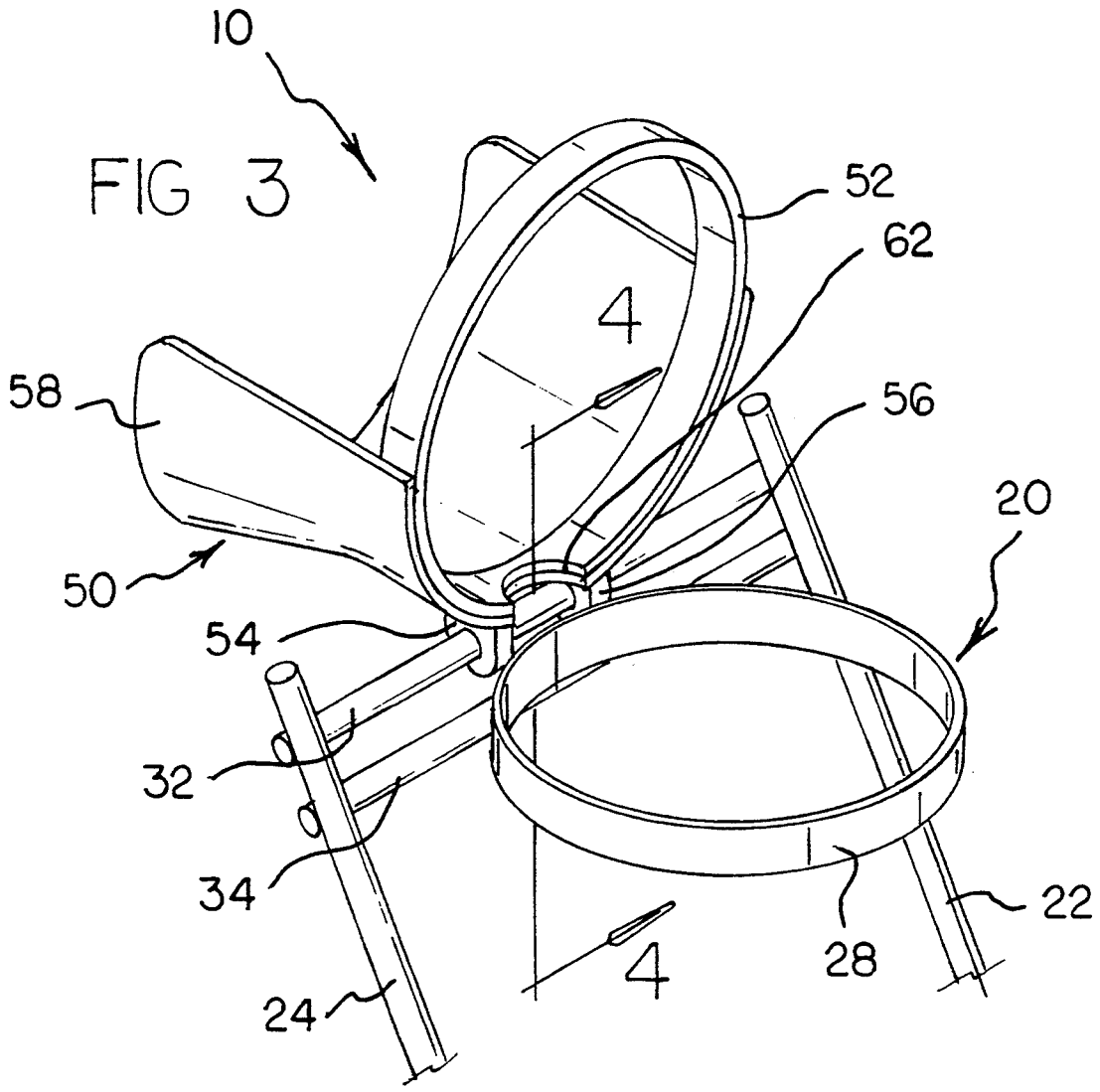
FIG. 3 is a partial perspective view of the sand bag filling aid of FIG. 1 showing the second hoop and fill-chute rotated back on the hinge ready for sandbag insertion.
Figure 4:
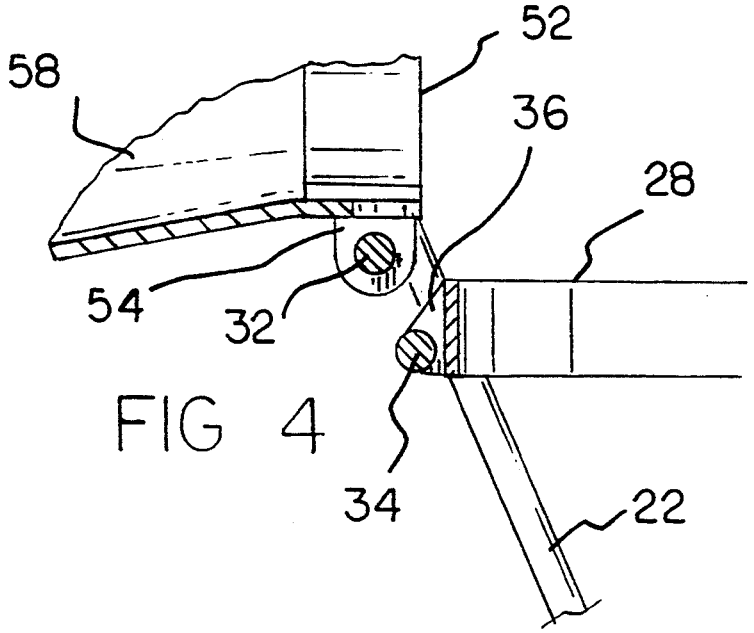
FIG. 4 is a partial sectional view of the invention of FIG. 3, taken along the line 4—4, illustrating the manner of connection of the first and second hoops.
Figure 7:
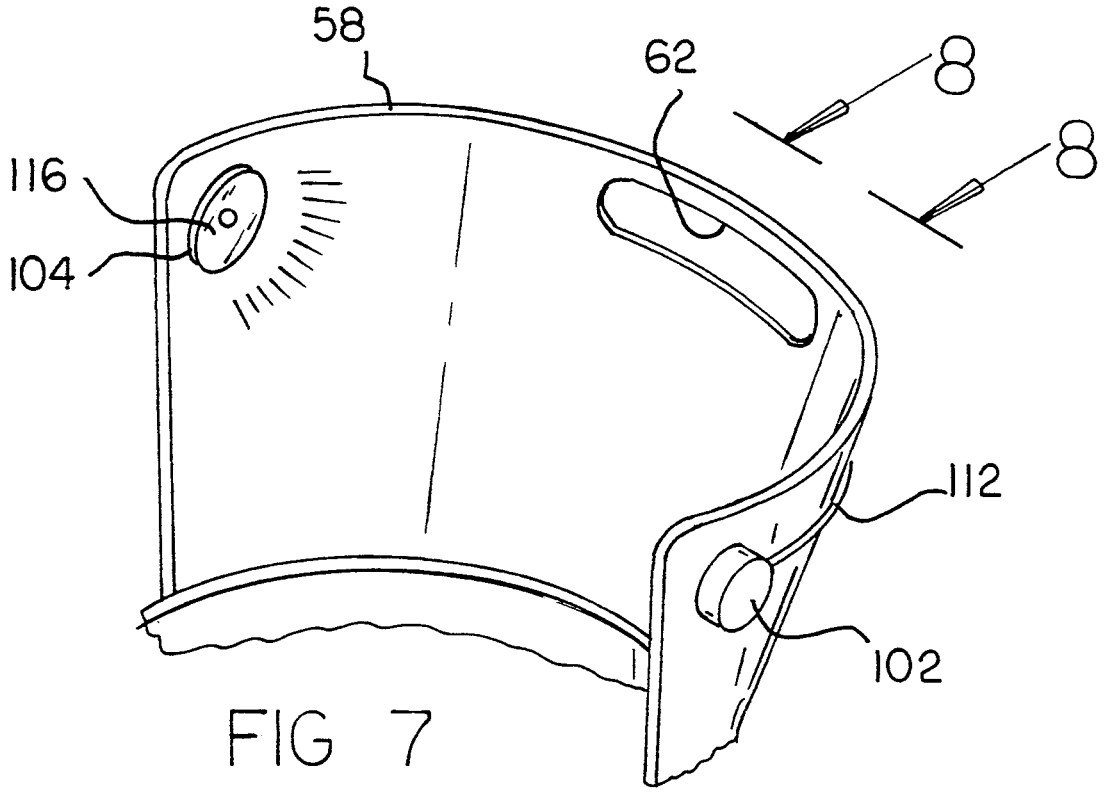
FIG. 7 is a perspective view of a third modification of the invention of FIG. 1 wherein work light means have been included with the fill-chute; also shown is the hand-grip opening of FIG. 5.
Figure 8:
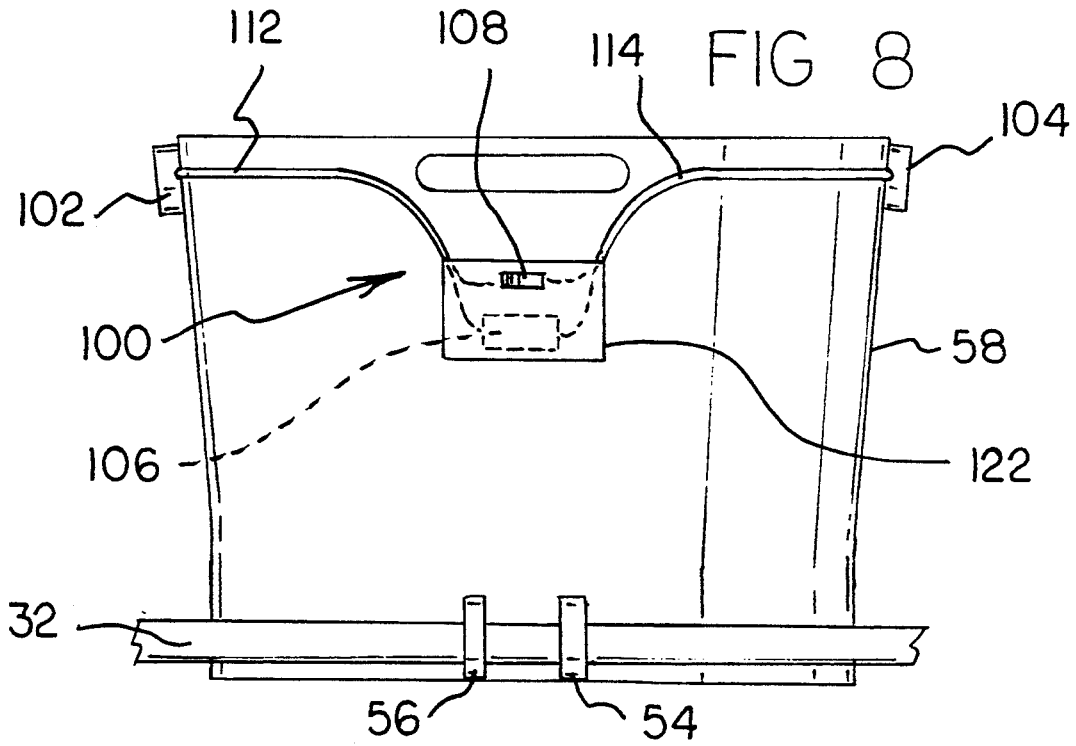
FIG. 8 is a partial rear elevational view of the present invention showing the work light energy source enclosure mounted to the back of the fill-chute.

With reference now to the drawings, and in particular to FIG. 1 thereof, a new and improved sandbag filling aid embodying the principles and concepts of the present invention and generally designated by the reference numeral 10 will be described.

From an overview standpoint, the sandbag filling aid is adapted for use to support a sandbag in an upright position and provide a fill-chute to enable a single person to rapidly and efficiently fill sandbags during emergency situations. See FIG. 1.

With reference now to FIGS. 1 through 4 and more specifically, it will be noted that a sandbag filling aid 10 for supporting a sandbag 150 in an upright position and providing a fill-chute 58 to enable a single person to rapidly and efficiently fill sandbags during emergency situations is described. The sandbag filling aid 10 comprises an open frame 20 having integral parallel left and right support columns 22 and 24.

The frame 20 is formed of rigid structural material such as tubular steel. The columns 22 and 24 are supported in a generally upright position and connected together at the lower ends by a laterally extending integral horizontal arcuate base member 26. The columns 22 and 24 are also fixedly connected together at their upper ends by an identical pair of vertically spaced apart horizontal cross-bar members 32 and 34. The columns 22 and 24 are angled slightly away from vertical in the direction of the base member 26 such that the frame center of gravity on a horizontal plane coincides with its geometric center thereby providing a stable tip-resistant structure.

The sandbag filling aid 10 also includes a first horizontal hoop 28 formed of rigid structural material such as steel band. The first horizontal hoop 28 has a diameter slightly smaller than the diameter of the mouth of a sandbag wherein the sandbag may be inserted and slightly overlapped 152 whereby holding the sandbag 150 in an upright open position. The first horizontal hoop 28 is fixedly tangentially connected 36 to the center of the lower cross-bar member 34 such that it is centered between the left and right support columns 22 and 24 and is also generally centered over the arcuate base member 26.

The sandbag filling aid 10 further includes a second horizontal hoop 52 formed of the same material as the first horizontal hoop 28. The second horizontal hoop 52 has a diameter slightly larger than the diameter of the mouth of a sandbag 150. The second horizontal hoop 52 is hingedly tangentially connected 54 to the center of the upper cross-bar member 32 such that it is centered over the first horizontal hoop 28 whereby a sandbag 150 inside the first hoop 28 may be removedly clamped when the second hoop 52 is rotated downwardly on its hinge 54 to contact the overlapped sandbag 152 on the first hoop 28.

The second horizontal hoop 52 also has a semi-cylindrical outwardly flaring chute member 58 fixedly coaxially connected thereto. The chute member 58 extends upwardly from the circumference of the second horizontal hoop 52 whereby hastily shovelled or thrown sand is caught and directed into the open mouth of the sandbag clamped into the sandbag filling aid 10.

In a first modification of the preferred embodiment of the sandbag filling aid, shown in FIG. 5, the chute member 58 additionally includes a hand-grip opening 62 therethrough whereby the user may quickly and easily grasp the chute 58 for transporting the sandbag filling aid 10 or for opening the second hoop 52 to remove or insert a sandbag.

Referring now to FIG. 6, a second modification of the preferred embodiment further includes transport wheel means 80 whereby the sandbag filling aid 10 may be quickly and easily moved to a different location. The wheel means 80 comprises a lateral hole through the lower ends of the left and right support columns 92 and 94, the holes being coaxial.

The wheel means 80 also includes a left and right wheel 84 and 86 formed of resilient durable material such as plastic or rubber, the wheels being identical to each other. The wheels 84 and 86 each have a central hub 96 and 98. The wheel means 80 further includes an axle rod 82 having a length slightly greater than the width of the arcuate base member 26 and a diameter essentially the same as the holes of the lower ends of the support columns 92 and 94.

The axle rod 82 is fixedly connected to the hub 96 of the left wheel 84, extends through the hole 92 in the lower end of the left support column 24, further extends through the hole 94 in the lower end of the right support column 22, and finally, is fixedly connected to the hub 98 of the right wheel 86.

Yet a third modification of the preferred embodiment of the sandbag filling aid 10 includes work light means 100 whereby the sandbag filling aid may be effectively used in dark locations away from mains power or generator sites. The work light means 100 comprises a plurality of electrical lamp fixtures 102 and 104 removedly connected to the chute member 58 such that the lamps 102 and 104 illuminate the inside of the chute member and the open mouth of the sandbag.

The electrical lamp fixtures 102 and 104 also have protective lens means 116 whereby damage to the lamp fixtures from thrown sand or other objects is precluded. The work light means 100 additionally includes a source of electrical energy 106, such as a battery, having voltage and current characteristics compatible with the lamps. The energy source 106 is operationally connected to the lamp fixtures 102 and 104 with electrical cable 112 and 114.

Further included in the work light means is electrical switch means 108 operationally connected in series between the electrical energy source 106 and the lamp fixtures 102 and 104 whereby the energy source may be interrupted or connected whereby turning the lamps off or on.

Lastly, the work light means 100 includes enclosure means 122 wherein the electrical energy source 106 is removedly received whereby protecting the energy source from damage. The enclosure means 122 also fixedly receives the electrical switch means 108 such that the switch means is operable from the outside of the enclosure 122. The enclosure means is fixedly connected to the outside of the chute member 58 whereby damage from thrown sand or other objects is precluded.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new and improved sandbag filling aid for supporting a sandbag in an upright position and providing a fill-chute to enable a single person to rapidly and efficiently fill sandbags during emergency situations, the sandbag filling aid comprising:

an open frame having integral parallel left and right support columns, the frame being formed of rigid structural material such as tubular steel, the columns being supported in a generally upright position and connected together at their lower ends by an integral horizontal arcuate base member, the columns also being fixedly connected together at their upper ends by top and bottom horizontal cross-bar members, the columns being angled slightly away from vertical in the direction of the base member such that the frame's center of gravity on a horizontal plane coincides with the frame's geometric center thereby providing a stable tip-resistant structure;

a first horizontal hoop formed of rigid structural material such as steel band, the first horizontal hoop having a diameter slightly smaller than the diameter of the mouth of a sandbag wherein the sandbag may be inserted and slightly overlapped such as to hold the sandbag in an upright open position, the first horizontal hoop being fixedly tangentially connected to the center of the bottom cross-bar member such that it is centered between the left and right support columns and is also generally centered over the arcuate base member; and a second horizontal hoop formed of the same material as the first horizontal hoop, the second horizontal hoop having a diameter slightly larger than the diameter of the mouth of a sandbag, the second horizontal hoop being hingedly tangentially connected to the center of the top cross-bar member such that it is centered over the first horizontal hoop whereby the sandbag inserted into the first hoop may be removedly clamped between the first and second horizontal hoops, the second horizontal hoop also having an semi-cylindrical outwardly flaring chute member fixedly coaxially connected thereto, the chute member extending upwardly from the circumference of the second horizontal hoop whereby hastily shovelled or thrown sand is caught and directed into the open mouth of the sandbag clamped into the sandbag filling aid.

2. The sandbag filling aid of claim 1 wherein the chute member additionally includes a hand-grip opening therethrough whereby the user may quickly and easily grasp the chute for transporting the sandbag filling aid or for opening the second hoop to remove or insert a sandbag.

3. The sandbag filling aid of claim 1 and further including transport wheel means whereby the sandbag filling aid may be quickly and easily moved to a different location, the wheel means comprising:

a lateral hole through the lower ends of the left and right support columns, the holes being coaxial;

a left and right wheel formed of resilient durable material such as plastic or rubber, the wheels being identical to each other, the wheels each having a central hub; and an axle rod having a length slightly greater than the width of the frame base member, the axle rod having a diameter essentially the same as the holes of the lower ends of the support columns, the axle rod being fixedly connected to the hub of the left wheel, the axle rod extending through the hole in the lower end of the left support column, the axle also extending through the hole in the lower end of the right support column, the axle further being fixedly connected to the hub of the right wheel.

4. The sandbag filling aid of claim 1 and further including work light means whereby the sandbag filling aid may be efficiently used in dark locations away from mains power or generator sites, the work light means comprising:

a plurality of electrical lamp fixtures removedly connected to the chute member such that the lamps illuminate the inside of the chute member and the open mouth of the sandbag, the electrical lamp fixtures also having protective lens means whereby damage to the lamp fixtures from thrown sand or other objects is precluded;

a source of electrical energy such as a battery having voltage and current characteristics compatible with the lamps, the energy source being operationally connected to the lamp fixtures;

electrical switch means operationally connected in series between the electrical energy source and the lamp fixtures whereby the energy source may be interrupted or connected whereby turning the lamps off or on; and enclosure means wherein the electrical energy source is removedly received, the enclosure means also fixedly receiving the electrical switch means such that the switch means is operable from the outside of the enclosure, the enclosure means being fixedly connected to the outside of the chute member whereby damage from thrown sand or other objects is precluded.

5. A new and improved sandbag filling aid for supporting a sandbag in an upright position and providing a fill-chute to enable a single person to rapidly and efficiently fill sandbags during emergency situations, the sandbag filling aid comprising:

an upright tubular frame structure having left and right parallel support columns, the support columns being generally vertical, the support columns having an integral horizontal arcuate base member protruding laterally from and interconnecting the bottom ends of the support columns, the support columns also having an identical pair of vertically spaced apart cross-bar members fixedly laterally connected between the upper ends of the support columns;

a first horizontal hoop member fixedly tangentially connected to the center of the lower cross-bar member wherein a sandbag may be inserted;

a second horizontal hoop member hingedly tangentially connected to the center of the upper cross-bar member coaxially with the first hoop member whereby a sandbag within the first hoop may be clamped in place by rotating the second hoop downward until it contacts the sandbag; and an arcuate fill-chute member extending upwardly and slightly outwardly from the second hoop member such that when the second hoop member is positioned for clamping a sandbag the chute will catch and direct hastily thrown sand into the mouth of the sandbag.

* * * * *